US006835119B2

(12) United States Patent
Hori

(10) Patent No.: US 6,835,119 B2
(45) Date of Patent: Dec. 28, 2004

(54) METHOD FOR LAPPING AND A LAPPING APPARATUS

(75) Inventor: Nobuyuki Hori, Ishikawa-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/787,980

(22) Filed: Feb. 27, 2004

(65) Prior Publication Data

US 2004/0166778 A1 Aug. 26, 2004

Related U.S. Application Data

(62) Division of application No. 10/314,384, filed on Dec. 9, 2002, now Pat. No. 6,722,951, which is a division of application No. 09/841,678, filed on Apr. 25, 2001, now Pat. No. 6,612,908.

(30) Foreign Application Priority Data

May 22, 2000 (JP) ..... 2000-149409

(51) Int. Cl.[7] ..... B24B 1/00
(52) U.S. Cl. ..... 451/36; 451/63; 451/692
(58) Field of Search ..... 451/36, 41, 5, 451/60, 63, 160, 262, 261, 268, 264, 287, 288, 267, 270–271, 286, 290, 291; 438/692, 693

(56) References Cited

U.S. PATENT DOCUMENTS 5,482,497 A * 1/1996 Gonnella et al. ..... 451/57
5,645,472 A * 7/1997 Nagahashi et al. ..... 451/261
5,885,143 A * 3/1999 Ichikawa et al. ..... 451/168
5,941,759 A * 8/1999 Kitajima et al. ..... 451/41
5,975,997 A * 11/1999 Minami ..... 451/287
6,185,801 B1 2/2001 Kadota et al.
6,419,564 B2 * 7/2002 Herrman et al. ..... 451/58
6,612,908 B2 * 9/2003 Hori ..... 451/36

FOREIGN PATENT DOCUMENTS

| | | |
|---|---|---|
| CN | 2124796 U | 12/1992 |
| CN | 1221255 A | 6/1999 |
| JP | 55-101356 | 8/1980 |
| JP | 4-371009 | 12/1992 |
| JP | 5-285806 | 11/1993 |
| JP | 9-172341 | 6/1997 |
| JP | 9-174394 | 7/1997 |
| JP | 9-262743 | 10/1997 |
| JP | 10-163789 | 6/1998 |

* cited by examiner

*Primary Examiner*—Lee D. Wilson
*Assistant Examiner*—Anthony Ojini
(74) *Attorney, Agent, or Firm*—Keating & Bennett, LLP

(57) ABSTRACT

A method for lapping which eliminates lapping damage includes a high-speed lapping operation at a high torque which is continuously performed after performing intermittently a low-speed lapping operation under low torque on a workpiece. Therefore, the excessive load during a first lapping stage due to the projection on the surface of the workpiece is greatly decreased. A continuous lapping is performed after the projection becomes smooth to some extent, and thus the lapping damage is prevented.

4 Claims, 6 Drawing Sheets

METHOD FOR LAPPING AND A LAPPING APPARATUS

This application is a Divisional of U.S. patent application Ser. No. 10/314,384 Filed Dec. 9, 2002, now U.S. Pat. No. 6,722,951, which is a Divisional of prior application Ser. No. 09/841,678 filed Apr. 25, 2001, now U.S. Pat. No. 6,612,908.

BACKGROUND OF THE INVENTION

1. Field of the Invention

The present invention relates to a method for lapping a workpiece such as a hard and brittle ceramic board, or any workpiece that is not so resistant to application of a point shock or force.

2. Description of the Related Art

Conventionally, when performing the lapping process to this type of hard and brittle workpiece, it is common to use a lapping apparatus called an epicyclic-gear system. The principal component of such an epicyclic-gear system is simplified and shown in FIG. 1. In this lapping apparatus, an epicyclic-gear-shaped carrier 2 holding several workpieces 1 is arranged between a sun gear 3 and a ring gear 4. Lap surface plates 5 and 6 are arranged at the upper surface and the lower surface of the carrier 2. In this state, the sun gear 3 and the ring gear 4 are rotated, injecting the lapping liquid in which grinding particles are mixed, between the lap surface plates 5 and 6 in that condition. The carrier 2 is caused to rotate and revolve thereby. The upper and lower surfaces of the workpiece 1 are polished by the sliding action between the upper and lower lap surface plates 5 and 6 and the workpiece 1.

In addition, the sun gear 3 and the ring gear 4 are respectively connected to the electric motor for driving (neither is illustrated) via a deceleration mechanism and stepless-transmission structure.

However, in the lapping apparatus including the lapping pressure-fluctuation system, because of various relationships, such as the lapping pressure, a movement torque and velocity, and mechanical static-friction power, the pressure-reduction range is limited. Also a workpiece 1 overflows a carrier 2 when the rotational power exceeding the maximum static-friction power is applied when the pressure is reduced too much. This workpiece 1 is pinched between the carrier 2 and the lap surface plate 5, thereby generating breaks, fractures and other damage to the workpiece.

Moreover, since velocity and a torque are raised stepwise as shown in FIG. 8 and lapping is performed when the lapping velocity increase system is adopted, a load that is first applied to the workpiece 1 can be made low. However, the situation cannot sufficiently prevent the lapping damage of a workpiece 1 from being generated as explained below.

That is, many small projections are formed on the surface of the workpiece 1. At the time of lapping, the grinding particles of the lapping liquid cut into these projections. Because the lapping velocity increase system uses a continuous driving, once grinding particles are encroached into the surface of a workpiece 1, the encroached grinding particles are not released. The workpiece 1 is going to rotate further under the condition of having the particles encroached therein, and then a large load is applied locally to a workpiece 1.

Therefore, the lapping damage imparted to the workpiece 1 is very large. Accordingly, generation of micro-cracks and other damage cannot be sufficiently prevented.

SUMMARY OF THE INVENTION

In order to overcome the problems described above, preferred embodiments of the present invention provide a method for lapping and a lapping apparatus which reliably prevent the generation of lapping damage and eliminates damage to workpieces that are lapped.

According to a preferred embodiment of the present invention, a method for lapping includes the steps of first performing a lapping operation intermittently to a workpiece, and then performing a lapping operation continuously to the workpiece after finishing the intermittent lapping operation.

According to another preferred embodiment of the present invention, a lapping apparatus includes an epicyclic-gear-shaped carrier capable of holding several workpieces, a sun gear and a ring gear which mesh with the carrier, a lap surface plate arranged in the upper portion and the lower portion of the carrier, and an electric motor arranged to rotate at least one of the sun gear and the ring gear, such that the lapping apparatus performs polishing while injecting lapping liquid in which grinding particles are mixed, between a workpiece and the upper and lower lap surface plates. The lapping apparatus also preferably includes a first controller for first-stage driving which performs the intermittent driving of the electric motor for driving at a low torque, a second controller for main driving which performs the continuous driving of the electric motor for driving at a high torque after finishing an intermittent driving at a low torque, and a switch arranged to switch between the first controller for first-stage driving, and a second controller for main driving.

According to yet another preferred embodiment of the present invention, a lapping apparatus includes an epicyclic-gear-shaped carrier capable of holding several workpieces, a sun gear and a ring gear which mesh with the carrier, lap surface plates arranged at the upper portion and the lower portion of the carrier, and an electric motor arranged to rotate at least one of the sun gear and the ring gear, such that the apparatus performs polishing of a workpiece by injecting lapping liquid in which grinding particles are mixed, between a workpiece and the upper and lower lap surface plates, and rotating at least one side of the sun gear and the ring gear.

The lapping apparatus also preferably includes a low torque drive circuit which performs the intermittent driving of at least one of the sun gear and the ring gear by the low torque motor, and a high torque drive circuit which performs the continuous driving of at least one of the sun gear and the ring gear by the high torque motor after finishing an intermittent driving, and a switch that is arranged to switch between the low torque drive circuit and the high torque drive circuit.

According to a method of various preferred embodiments of the present invention, a lapping operation is first performed intermittently on a workpiece. In such an intermittent lapping process, if rotational power is applied, the grinding particles of the lapping liquid will be encroached into the projections which exist on the surface of a workpiece, and a load will become large suddenly. However, the load is released by stopping, before that load becomes excessive. Therefore, generation of the serious lapping damages, such as micro cracks, is reliably prevented. By performing the predetermined number of these intermittent movements, the projections on the surface of the workpiece are removed to some extent, and become smooth. Maximum static-friction power can be made small according to a predetermined value. Furthermore, in the continuous lapping process performed subsequently, the surface condition of a workpiece is to some extent smooth. Thus, the point impact force which acts on a workpiece becomes much weaker. The surface of a workpiece can be polished to a desired smoothness, while preventing any damage to the workpiece, even when the workpiece is lapped continuously.

In addition, the procedure for performing a lapping operation intermittently, may be perform manually or mechanically.

It is preferred that the intermittent lapping operation is performed with a low torque and a low speed. It is also preferred that the continuous lapping operation is performed with a high torque and high speed.

If intermittent lapping is performed with a high speed or high torque, the load applied to the projection of a first stage workpiece which has a large frictional resistance is large and the damage to the workpiece is also large.

On the other hand, when an intermittent lapping operation is performed with a low torque and low speed, and a continuous lapping operation is performed with a high torque and at high speed, the workpiece is polished slowly without applying a large load to the original workpiece having projections, and then the workpiece is polished at a high speed in the stage where the workpiece is smooth to some extent. The elimination of workpiece damage and the improvement in polishing efficiency are achieved.

It is preferred that the intermittent lapping operation is performed while varying the angle range gradually within a small angle range.

That is, at the start of an intermittent lapping operation, the polishing of a projection is performed, alleviating the point impact force that is otherwise imparted to a workpiece by moving in the small angle range, because there are a large number of the projections on the surface of a workpiece. Also, as the number of projections decreases, by extending the angle range, the projection can be made smooth effectively.

It is also preferred to perform the intermittent lapping operation while reducing the welding pressure applied to the workpiece, as compared to the welding pressure applied to the workpiece during a continuous lapping operation.

That is, an intermittent lapping is performed under reduced welding pressure applied to the workpiece, so that only the projection which exists on the surface of a workpiece can be polished with a small welding pressure. Further, generation of breaking or cracking by excessive welding pressure locally acting on a workpiece is reliably prevented. Moreover, since the pressure is reduced only at the intermittent rotation time, rotational power exceeding maximum static-friction power is not applied and a workpiece does not overflow a carrier.

According to another preferred embodiment of the present invention, because the electric motor for driving is made to switch from intermittent driving with a low torque to continuous driving with a high torque, only one electric motor for driving is required and thus, the size and cost of the apparatus can be reduced.

The switch described above may include an inverter for varying the torque and the rotational speed of the motor. Alternatively, a transmission device may be used to vary the torque or the rotational speed of the motor.

Alternatively, a low torque motor and a high torque motor may be provided and switched selectively to switch between the intermittent lapping and the continuous lapping, such that the controller is quite simple.

Other elements, characteristics, features and advantages of the present invention will become more apparent from the following detailed description of preferred embodiments of the present invention with reference to the attached drawings.

DETAILED DESCRIPTION OF PREFERRED EMBODIMENTS

Hereafter, the examples of preferred embodiments of the present invention are explained with reference to drawings.

Figure 1:
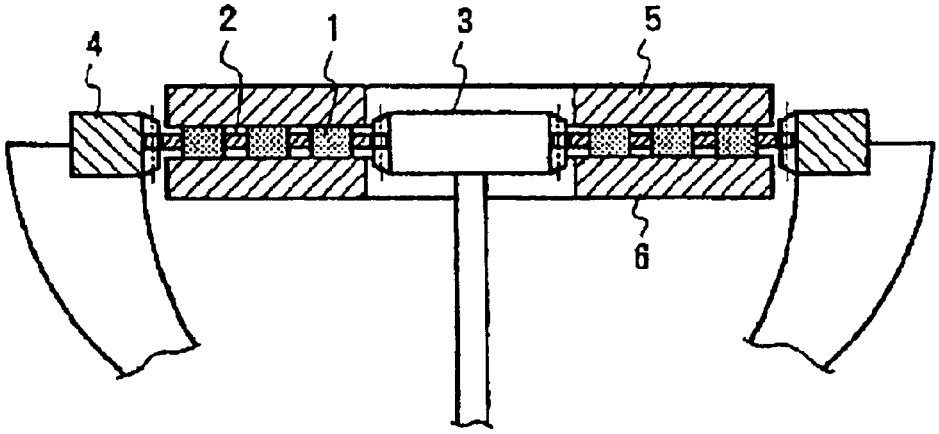
FIG. 1 is an explanatory drawing that is simplified to show only the principal construction of the lapping apparatus used in preferred embodiments of the present invention.
Figure 2:
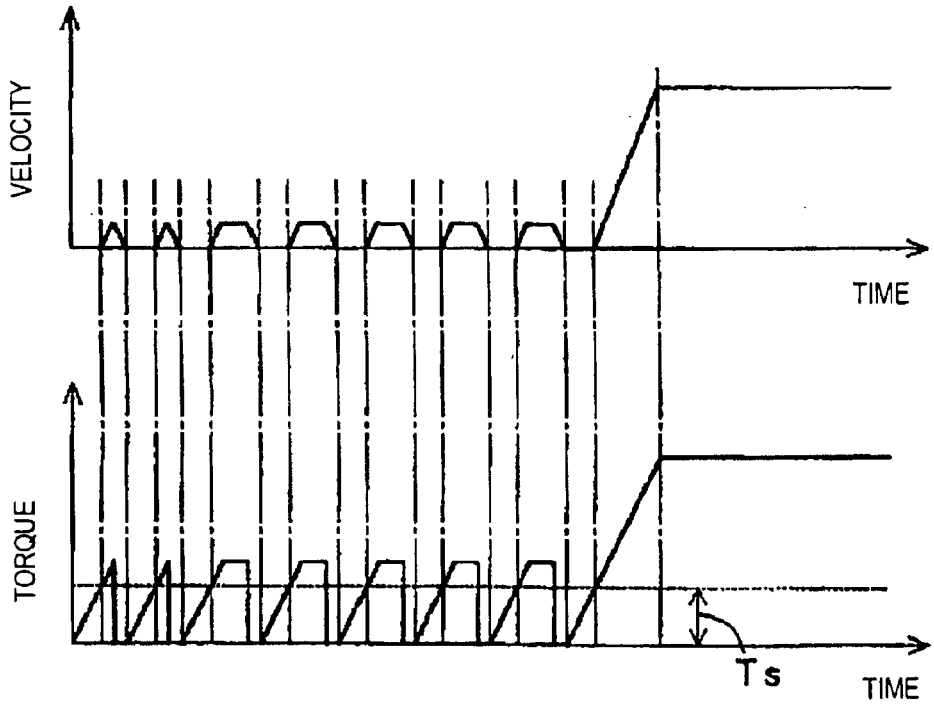
FIG. 2 is a time change diagram of the torque and the velocity of the lapping method according to a preferred embodiment of the present invention.
Figure 3:
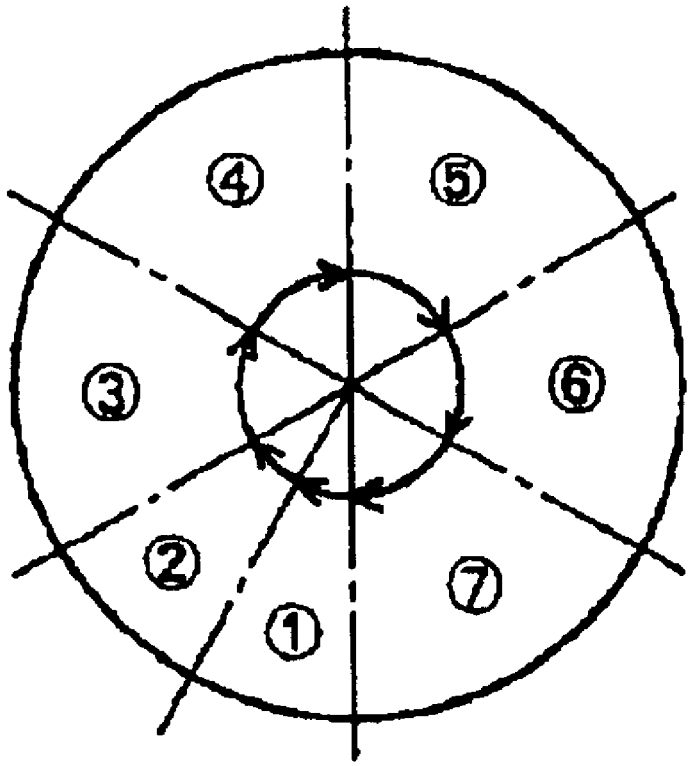
FIG. 3 is an explanatory drawing of the procedure of a preferred embodiment of the present invention.

FIG. 1 is an explanatory drawing that has been simplified to show the principal component of the lapping apparatus used in the execution of a method according to a preferred embodiment of the present invention. FIG. 2 is an explanatory drawing showing a time-dependent change of the torque and velocity in this preferred embodiment of the present invention. FIG. 3 is an explanatory drawing showing the procedure of this preferred embodiment.

In addition, the lapping apparatus used in a method of various preferred embodiments of the present invention has a configuration that is not so fundamentally different from a conventional apparatus. Therefore, explanation based on FIG. 1 which is similar to a conventional apparatus will be provided.

Figure 7:
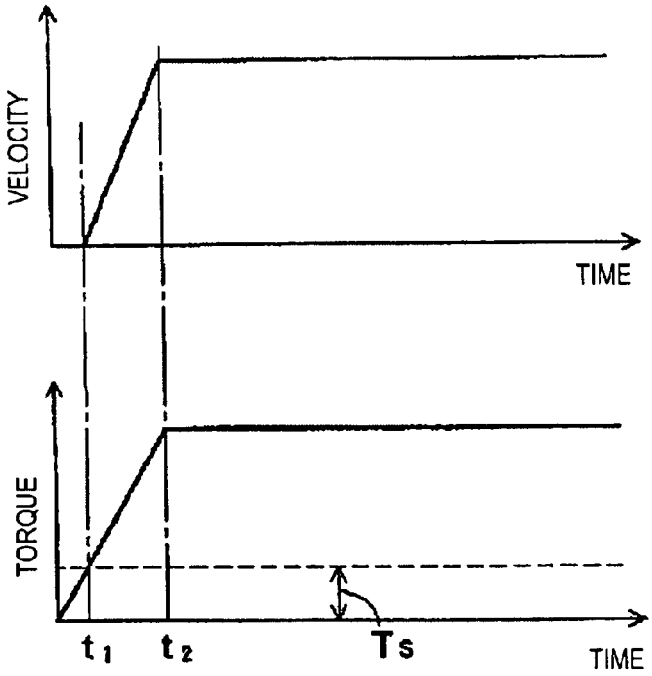
FIG. 7 PRIOR ART
FIG. 7 is a time change diagram of the torque and velocity in the conventional lapping velocity increase system.
Figure 8:
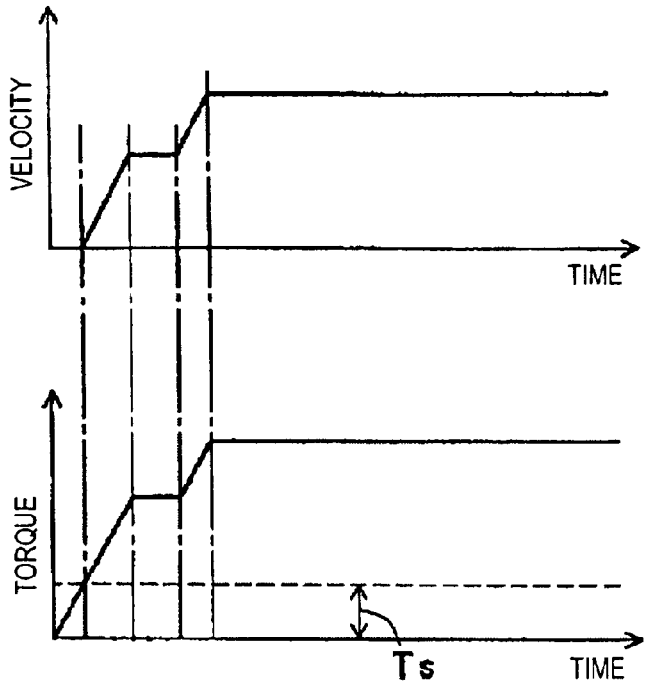
FIG. 8 PRIOR ART
FIG. 8 is the time change diagram of the torque and the velocity in the conventional lapping velocity increase system.

In this lapping apparatus, the carrier 2 holding several workpieces 1 is arranged between the sun gear 3 and the ring gear 4. Lap surface plates 5 and 6 are arranged at an upper portion and a lower portion of the carrier 2, respectively. The sun gear 3 and the ring gear 4 are driven by the electric motor for driving (neither is illustrated) connected via a deceleration mechanism and non-transmission structure, while injecting the lapping liquid in which grinding particles were mixed. Both gears 3 and 4 make the carrier 2 rotate and revolve. The driving switch (not illustrated) is included with this lapping apparatus. In the lapping apparatus, after turning on the driving switch, a similar lapping operation as shown in FIG. 7 of the prior art example occurs. In other words, the machine lapping process in which the high-speed lapping operation under a high torque continues, is performed.

Moreover in the method of the present preferred embodiment of the present invention, a low torque and low-speed lapping operation on a workpiece 1 is performed intermittently before a high torque and high-speed machine lapping process is performed by the lapping apparatus. The lapping process according to this preferred embodiment is shown in FIG. 2. The lapping process in this preferred embodiment is performed by an operator holding the ring gear 4 of a lapping apparatus with both hands, for example, and performing the rotation operation of the ring gear 4 for every arbitrary small angle range sequentially. In FIG. 2, a broken line shows the starting torque for resisting maximum static-friction power and rotating the lapping apparatus.

More specifically, in this preferred embodiment, the steps of the method are preferably performed in the order of steps (1) to (7) as they appear in the model explanatory drawing shown in FIG. 3. First, a rotation operation (1), (2) of a ring gear 4 is performed intermittently at approximately 30 degrees of 2 times for about 3 seconds or more preferably via manual operation, and then a rotation operation (3) to (7) of a ring gear 4 is performed intermittently at approximately 60 degrees of 5 times for about 4 seconds or more preferably via manual operation. Thus, the lapping process is performed with a low torque and a low speed by one revolution (360 degrees) for about 20 seconds or less. In other words, in this lapping process, it is preferable to perform the lapping process while extending the angle range gradually from the small angle range. In addition, the pressure-reduction mechanism is provided for the usual lapping apparatus. The lapping process with such a low torque and a low speed in this preferred embodiment is performed by the first-stage lapping flow and under a reduced pressure. The subsequent additional machine lapping process that is similar to the prior art example, in other words, the usual machine lapping process in which the high-speed lapping operation with a high torque continues will be performed subsequently on the workpiece 1, after the lapping which is intermittently performed with a low torque and a low speed according to the procedures explained above.

The inventor of the present invention performed the lapping process on a workpiece 1 using the procedures of this preferred embodiment of the present invention. The inventor confirmed that cracking and other damage to the workpiece 1 does not occur when using the present preferred embodiment of the present invention. Also, the rate of occurrence of micro-cracks generated after the lapping process was also reduced greatly. For example, it was confirmed that when the lapping process was performed according to the conventional procedure shown in FIG. 7, the rate of occurrence of a micro-crack was about 13%, and on the other hand, when the lapping process was performed according to the preferred embodiment of the present invention as shown in FIG. 2, the rate of occurrence of a micro-crack was reduced to about 0.3%.

The reason why the favorable results described above were obtained is considered based on the following. According to the procedure of the present preferred embodiment, first, the low-speed lapping operation with a low torque is performed. Accordingly, the projection existing on the surface of a workpiece 1 will be removed to some extent. The surface condition of a workpiece 1 becomes smooth to some extent during this initial intermittent lapping process. Such a lapping process with a low torque and a low speed is performed intermittently. Thus, the grinding particles of the lapping liquid which encroach into the projection on the surface of a workpiece are released by stopping of the lapping operation during the intermittent lapping process. Therefore, occurrence of serious lapping damages, such as a micro-crack or other damage, is reliably prevented. Furthermore, in the continuous high torque and high-speed lapping process which is performed after the intermittent lapping process, the surface condition of a workpiece is smooth to some extent. Accordingly, the point impact force which is applied to a workpiece during the continuous lapping process is much less and much weaker, and consequently, lapping damage is not generated.

Generally, the lapping time of one lapping operation is preferably about 6 minutes. Since the intermittent lapping operation performed at first is about 20 seconds at maximum, the time required to perform intermittent lapping compared to the entire lapping time is very short. Thus, lapping efficiency is not reduced by the present preferred embodiment.

In addition, in the execution of the lapping process, it is possible to increase the grinding-particles density in the lapping liquid to about 7% from about 4.8%.

Figure 4:
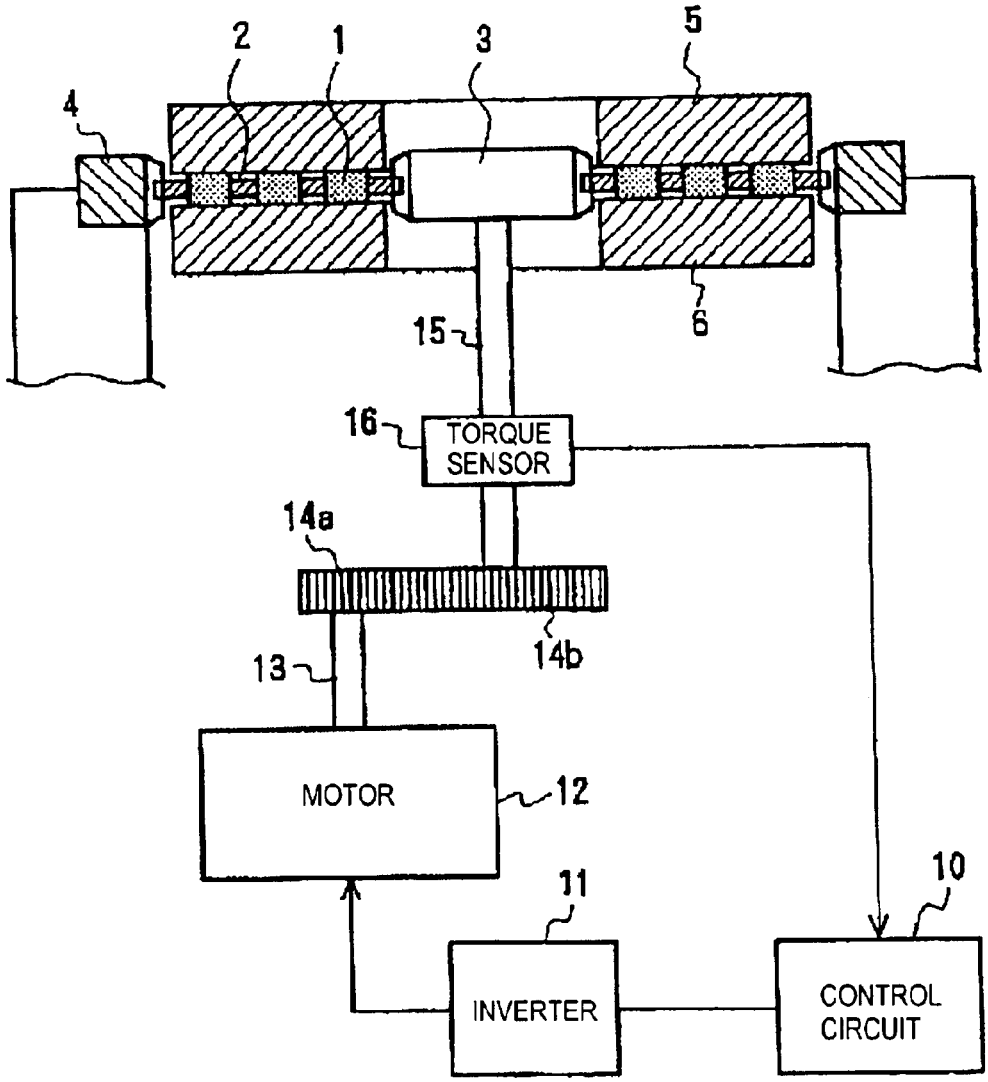
FIG. 4 is a structural drawing of a second preferred embodiment of the lapping apparatus of the present invention.

FIG. 4 shows a second preferred embodiment of the present invention which relates to a lapping apparatus used to perform the methods of other preferred embodiments of the present invention.

Although the intermittent lapping process with a low torque and a low speed was performed manually in the preferred embodiment described above, the intermittent lapping process is automated in this second preferred embodiment of the present invention.

Since the configuration of the carrier 2 of the lapping apparatus, the sun gear 3, the ring gear 4, the lap surface plates 5 and 6, are preferably the same as that of FIG. 1, and therefore repetitious explanation of these same elements is omitted.

In the second preferred embodiment shown in FIG. 4, a control apparatus 10 is provided and includes a stored program for operation thereof. The control apparatus 10 is connected with the electric motor 12 for driving via the inverter 11.

An inverter 11 controls a frequency according to the command from the control apparatus 10, and performs the rotational-speed control of the electric motor 12.

The revolving shaft 13 of the electric motor 12 is connected to the drive shaft 15 of the sun gear 3 via the deceleration gears 14*a* and 14*b*. The torque sensor 16 is provided midway through a drive shaft 15 and is arranged to detect a torque applied to the drive shaft 15. The torque sensor 16 transmits a detecting signal to the control apparatus 10.

In the case of the lapping apparatus of this preferred embodiment, the intermittent lapping operation is performed during the early stages of the overall lapping process, such that the lapping operation is stopped by suspending operation of the electric motor 12 when the torque of the drive shaft 15 exceeds a predetermined value while performing the low-speed drive of the electric motor 12 by the inverter 11.

The frequency of the inverter 11 is changed after the intermittent lapping operation of a predetermined frequency or a predetermined time. Then the process and operation of the inverter 11 transfers to the continuous high speed and high torque lapping operation. Thus, a lapping process can be performed automatically and in a manner similar to the procedure of FIG. 2.

Figure 5:
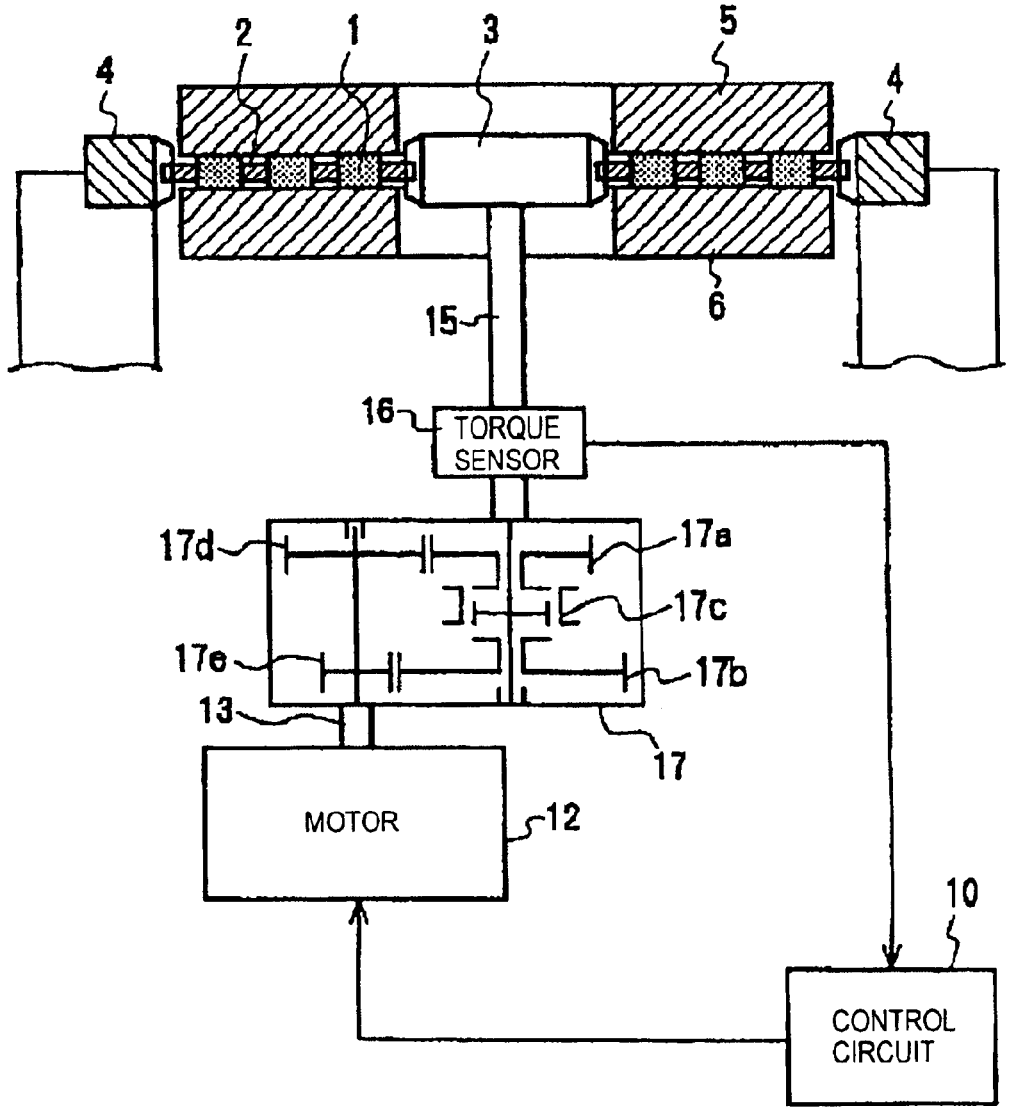
FIG. 5 is a structural drawing of a third preferred embodiment of the lapping apparatus according to the present invention.

FIG. 5 shows a third preferred embodiment of the lapping apparatus according to the present invention.

In this preferred embodiment, the revolving shaft 13 of the electric motor 12 is connected to the drive shaft 15 of the sun gear 3 via the transmission structure 17 which can vary reduction ratio into two different steps. Two gears 17*a* and 17*b* are rotatably supported on the drive shaft 15 inside the transmission structure 17. A switch 17*c* is arranged to selectively connect these gears 17*a* and 17*b* with the drive shaft 15. The gears 17*d* and 17*e* meshed with the gears 17*a* and 17*b* are fixed to the revolving shaft 13 of the electric motor 12.

In a first stage of an intermittent lapping operation, the switch 17*c* is switched to connect the gear 17*b* to the drive shaft 15. The driving force of the electric motor 12 is transmitted to the drive shaft 15 via gears 17*e* and 17*b*. Because the reduction ratio of gears 17*e* and 17*b* is large, the electric motor 12 will be stopped if the torque of the drive shaft 15, which rotates at a low speed, exceeds a predetermined value. The intermittent lapping operation at a low speed and a low torque is thus performed.

The switch 17*c* is then switched to connect the gear 17*a* to the drive shaft 15 after the intermittent lapping operation of a predetermined frequency or predetermined time. The driving force of the electric motor 12 is transmitted to the drive shaft 15 via gears 17*d* and 17*a*.

The continuous drive of the electric motor 12 is performed by rotating the drive shaft 15 at a high-speed rotation because the reduction ratio of gears 17*d* and 17*a* is small. The continuous lapping operation with a high speed and a high torque is thus performed.

Figure 6:
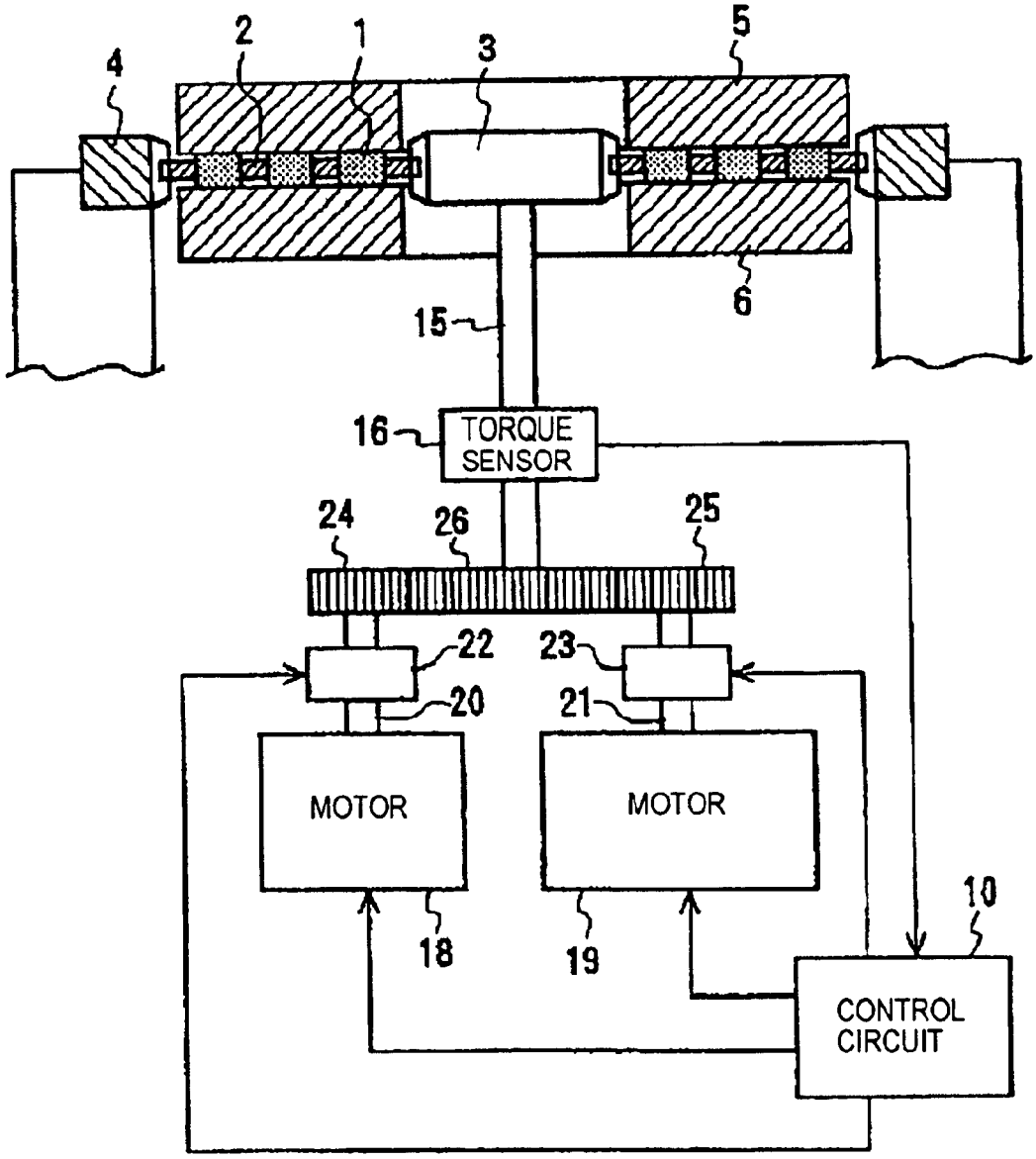
FIG. 6 is a structural drawing of a fourth preferred embodiment of the lapping apparatus of the present invention.

FIG. 6 shows a fourth preferred embodiment of the lapping apparatus according to the present invention.

Two electric motors 18 and 19 are preferably included in this preferred embodiment. One electric motor 18 operates with a low speed rotation and a low torque. Another electric motor 19 operates with a high-speed rotation and a high torque. Electromagnetic clutches 22 and 23 are provided midway through the revolving shafts 20 and 21 of both electric motors 18 and 19, and an intermittent control is performed via a control apparatus 10. Gears 24 and 25 are respectively fixed to revolving shafts 20 and 21. The gears 24 and 25 are arranged to be meshed with the gear 26 fixed to the drive shaft 15 of the sun gear 3.

During the lapping process, a clutch 22 is connected at first and a clutch 23 is released. An electric motor 18 will be stopped if the torque of a drive shaft 15 exceeds a predetermined value, while a drive shaft 15 will rotate with a low speed when the first electric motor 18 is driven. The intermittent lapping operation with a low speed and a low torque is thus performed. A clutch 22 is released and a clutch 23 is connected after the intermittent lapping operation of a predetermined frequency or predetermined time. Also, the continuous drive of the electric motor 19 is performed while a drive shaft 15 performs high-speed rotation if the second electric motor 19 is driven. The continuous lapping operation at a high speed and a high torque is thus performed.

In the example of the FIGS. 4 to 6, the torque sensor 16 is preferably provided with the drive shaft 15 of a sun gear 3. The torque of a drive shaft 15 is detected and an intermittent lapping operation is performed. However, the torque does not necessarily need to be detected. For example, a torque limiter may be provided on a drive shaft 15. A torque limiter is changed into slip condition (condition of sliding the torque more than a predetermined amount), only at the time of a first stage intermittent lapping operation. At the time of a continuous lapping operation, a torque limiter is changed into fastening condition. A switching control may be performed in this manner. Also in this case, such a load (torque) applied to a workpiece 1 can be limited below a fixed value.

Moreover, as shown in FIG. 3, an intermittent lapping operation may be performed by this time control.

In addition, the workpieces 1 that may be lapped by the preferred embodiments of the present invention include a piezoelectric body, a dielectric body, an insulating ceramic board, crystal, or other suitable elements, for example. However, of course, it is not limited to these.

As explained above, according to various preferred embodiments of the present invention, after performing an intermittent lapping operation first, a continuous lapping operation is performed. Therefore, the lapping process will be performed after removing the projection on the workpiece surface to some extent beforehand. As a result, lapping is performed efficiently and eliminates damage to the workpiece due to lapping.

During the intermittent lapping operation, an excessive load is not applied to a workpiece because the grinding particles of the lapping liquid which are encroached into the projection on the surface of a workpiece are released by stopping the lapping operation. Thus, generation of serious lapping damage, such as a micro-crack is reliably prevented.

Moreover, according to a lapping apparatus of a preferred embodiment of the present invention, the electric motor for driving is switched to a stage in which the motor performs an intermittent drive at a low torque, and a stage in which the motor performs a continuous drive at a high torque. This preferred embodiment can achieve the advantages of various preferred embodiments of the present invention while using only one electric motor, which also reduces the size and cost of the lapping apparatus.

Furthermore, according to another lapping apparatus of another preferred embodiment of the present invention, a low torque motor and a high torque motor are provided and switched selectively, and an intermittent lapping and a continuous lapping are thereby performed. In this preferred embodiment, control and switching between the intermittent lapping and the continuous lapping is quite simple.

While preferred embodiments of the invention have been disclosed, various modes of carrying out the principles disclosed herein are contemplated as being within the scope of the following claims. Therefore, it is understood that the scope of the invention is not to be limited except as otherwise set forth in the claims.

What is claimed is:

1. A lapping apparatus for lapping a workpiece, the apparatus comprising:

an epicyclic-gear-shaped carrier capable of holding several workpieces;

a sun gear arranged to mesh with the carrier;

a ring gear arranged to mesh with the carrier;

lap surface plates arranged at the upper portion and the lower portion of the carrier, respectively;

an electric motor for driving the carrier and which rotates at least one of the sun gear and the ring gear;

a low torque motor;

a high torque motor;

a low torque drive circuit arranged to perform an intermittent driving of at least one of the sun gear and the ring gear via the low torque motor;

a high torque drive circuit arranged to perform a continuous driving of at least one of the sun gear and the ring gear via the high torque motor after the intermittent driving is finished; and a switch arranged to switch operation between the low torque drive circuit and the high torque drive circuit.

2. The lapping apparatus according to claim 1, further comprising a lapping liquid application device arranged to apply a lapping liquid during the intermittent and continuous lapping processes.

3. The lapping apparatus according to claim 1, wherein the low torque motor has a first drive shaft and a first electromagnetic clutch fixed to the first drive shaft and the high torque motor has a second drive shaft and a second electromagnetic clutch fixed to the second drive shaft, and the switch is arranged to actively engage and disengage the first and second clutches to change from the intermittent driving to the continuous driving.

4. The lapping apparatus according to claim 3, wherein the low torque motor will be stopped if the torque of the first drive shaft exceeds a predetermined value.

* * * * *